US007632063B2

(12) United States Patent
Takeuchi et al.

(10) Patent No.: US 7,632,063 B2
(45) Date of Patent: Dec. 15, 2009

(54) FAN AND BLOWER UNIT HAVING THE SAME

(75) Inventors: Kazuhiro Takeuchi, Okazaki (JP); Takahiro Iwasaki, Okazaki (JP); Shinichi Oda, Okazaki (JP)

(73) Assignee: Denso Corporation, Kariya (JP)

( * ) Notice: Subject to any disclaimer, the term of this patent is extended or adjusted under 35 U.S.C. 154(b) by 444 days.

(21) Appl. No.: 11/526,808

(22) Filed: Sep. 25, 2006

(65) Prior Publication Data

US 2007/0071603 A1 Mar. 29, 2007

(30) Foreign Application Priority Data

Sep. 27, 2005 (JP) ..... 2005-280412

(51) Int. Cl.
*F01D 5/12* (2006.01)

(52) U.S. Cl. ..... 415/119; 415/173.6; 415/228; 416/169 A; 416/189; 416/192; 416/195; 416/500

(58) Field of Classification Search ..... 415/119, 415/173.6, 173.1, 228; 416/169 A, 189, 416/190, 192, 195, 500
See application file for complete search history.

(56) References Cited

U.S. PATENT DOCUMENTS 855,131 A * 5/1907 Preidel ..... 415/221
1,441,852 A * 1/1923 Heintz ..... 416/195
4,505,641 A * 3/1985 Tsuchikawa et al. ..... 416/189
5,405,243 A * 4/1995 Hurley et al. ..... 416/189
5,437,541 A * 8/1995 Vainrub ..... 416/223 R
6,027,307 A * 2/2000 Cho et al. ..... 415/173.5
7,083,387 B2 * 8/2006 Chen et al. ..... 416/195
2005/0074333 A1 4/2005 Iwasaki et al.

* cited by examiner

*Primary Examiner*—Igor Kershteyn
(74) *Attorney, Agent, or Firm*—Harness, Dickey & Pierce, PLC

(57) ABSTRACT

A fan has a plurality of blades extending in a radial direction with respect to a rotation axis and a ring portion disposed on radial outside edges of the blades. Further, the fan has a first connecting wall and a second connecting wall. The first connecting wall extending from the ring portion to a portion of the radial outside edge of each blade, the portion protruding from the ring portion toward an upstream position with respect to an air flow direction. The second connecting wall has a generally triangular shape. The second connecting wall continuously extends from the first connecting wall and connects to the ring portion on a leading side of the first connecting wall with respect to a rotation direction of the blade. The fan is for example housed in a shroud, thereby to construct a blower unit.

13 Claims, 5 Drawing Sheets

FAN AND BLOWER UNIT HAVING THE SAME

CROSS REFERENCE TO RELATED APPLICATION

This application is based on Japanese Patent Application No. 2005-280412 filed on Sep. 27, 2005, the disclosure of which is incorporated herein by reference.

FIELD OF THE INVENTION

The present invention relates to a fan having a ring portion at radial outside edges of fan blades and a blower unit having the fan.

BACKGROUND OF THE INVENTION

Japanese Publication No. 2005-106003 (US 2005/0074333 A1) discloses a fan having a ring portion on radial outside edges of blades, as shown in FIG. 9. The ring portion 130 has an axial dimension smaller than an axial dimension of the blade 120 with respect to an axial direction of the fan 100. The ring portion 130 has an annular wall extending generally in the axial direction and an extending portion 131 extending in a radial outside in a form of bell from an upstream end of the annular wall.

In the fan shown in FIG. 9, the extending portion 131 is disposed such that a base point connecting to the annular wall of the ring portion 130 is arranged in a range that begins at a point 25% and ends at a point 85% of a distance from an upstream end 122 of the radial outside edge 121 of the blade 120 with respect to the axial dimension of the blade 120 so as to improve air blowing efficiency. Namely, the upstream end 122 of the blade 120 is located upstream of the ring portion 130.

Further, the fan 100 has a connecting wall 133 on the upstream end 122 of the blade 120 so as to reduce air leakage from a positive pressure side to a negative pressure side at the radial outside edge 121 of the blade 120. The connecting wall 133 extends in the axial direction and connects to the ring portion 130. However, a leading end 133*a* of the connecting wall 133 is substantially perpendicular to a rotation direction D1 of the fan 100. During the rotation, the leading end 133*a* moves at once as going across air that flows into the blades 120 in a radially inward direction. Therefore, air (arrows A1) is likely to be disturbed around the leading end 133*a*, resulting an increase of noise.

SUMMARY OF THE INVENTION

The present invention is made in view of the foregoing matters, and it is an object of the present invention to provide a fan having a connecting wall portion at a radial outside edge of a fan blade, which is capable of reducing disturbance of air flow, and a blower unit having the fan.

According to an aspect of the present invention, a fan has a plurality of blades extending in a radial direction with respect to a rotation axis and a ring portion disposed on radial outside edges of the blades. The radial outside edges of the blades protrude from the ring portion toward an upstream position with respect to an air flow direction. The fan further has a first connecting wall and a second connecting wall. The first connecting wall extends between the ring portion and a portion of the radial outside edge of each blade, the portion protruding from the ring portion. The second connecting wall has a generally triangular shape. The second connecting wall extends from the first connecting wall and connects to the ring portion on a leading side of the first connecting wall with respect to a rotation direction of the blade.

Accordingly, the second connecting wall defines a leading end that is inclined with respect to the rotation direction. During the rotation of the fan, the leading end moves obliquely with respect to the rotation direction. Therefore, it is less likely that air flowing into the blades from a radially outward direction will be disturbed. As such, noise due to disturbance of air will be reduced.

The above fan is for example employed to a blower unit having a shroud. The shroud has a base portion defining a shroud outline, a shroud ring portion and an air guide portion extending from the shroud ring portion to the base portion. The fan is housed such that the ring portion is located radially inside of the shroud ring portion. Since the above fan structure efficiently reduces noise, a noise reduction property of the blower unit improves. In case that the above fan is housed in a shroud in which the shroud ring portion is displaced and the fan is partly located outside of the outline of the base portion, the noise reduction property further improves.

BRIEF DESCRIPTION OF THE DRAWINGS

Other objects, features and advantages of the present invention will become more apparent from the following detailed description made with reference to the accompanying drawings in which like parts are designated by like reference numbers and in which.

DETAILED DESCRIPTION OF EXAMPLE EMBODIMENT

An example embodiment of the present invention will now be described with reference to FIGS. 1 to 7.

Figure 1:
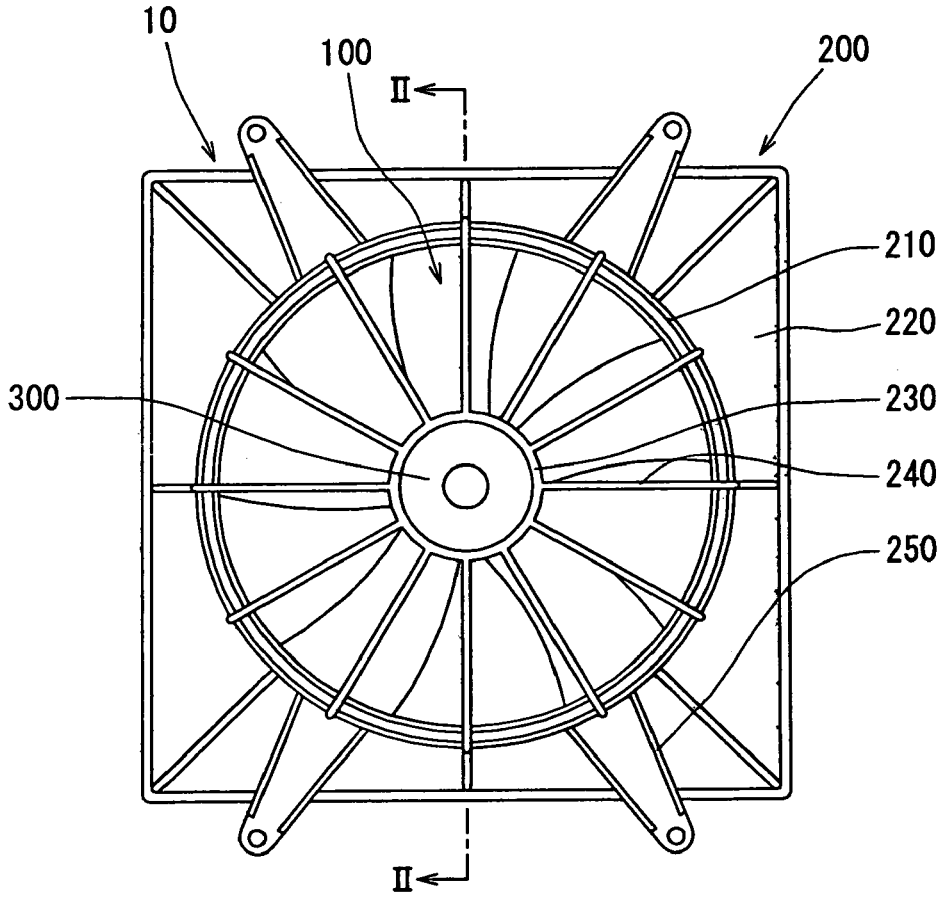
FIG. 1 is a plan view of a blower unit having a cooling fan according to an example embodiment of the present invention.

As shown in FIG. 1, a cooling fan 100 is for example employed in a blower unit 10. The cooling fan 100 is housed in a shroud 200 and driven by a motor 300, as an electric fan.

Figure 2:
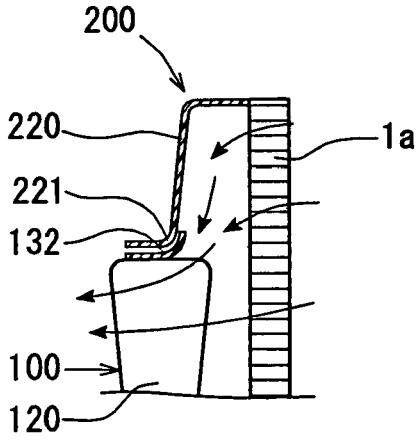
FIG. 2 is a schematic cross-sectional view of the blower unit taken along a line II-II in FIG. 1.

For example, the blower unit 10 is fixed to a vehicle radiator (not shown) through four fixing portions 250 provided at the corners of the shroud 200. As shown in FIG. 2, the blower unit 10 is arranged on an engine side of a core portion 1*a* of the radiator and used to cause cooling air to pass through the core portion 1*a* of the radiator (arrows in FIG. 2). For example, the blower unit 10 is a suction-type and disposed to suck the cooling air into the engine through a grill of the vehicle. Namely, the blower unit 10 causes the cooling air to pass through the core portion 1*a* of the radiator and then flow into the cooling fan 100.

Figure 3:
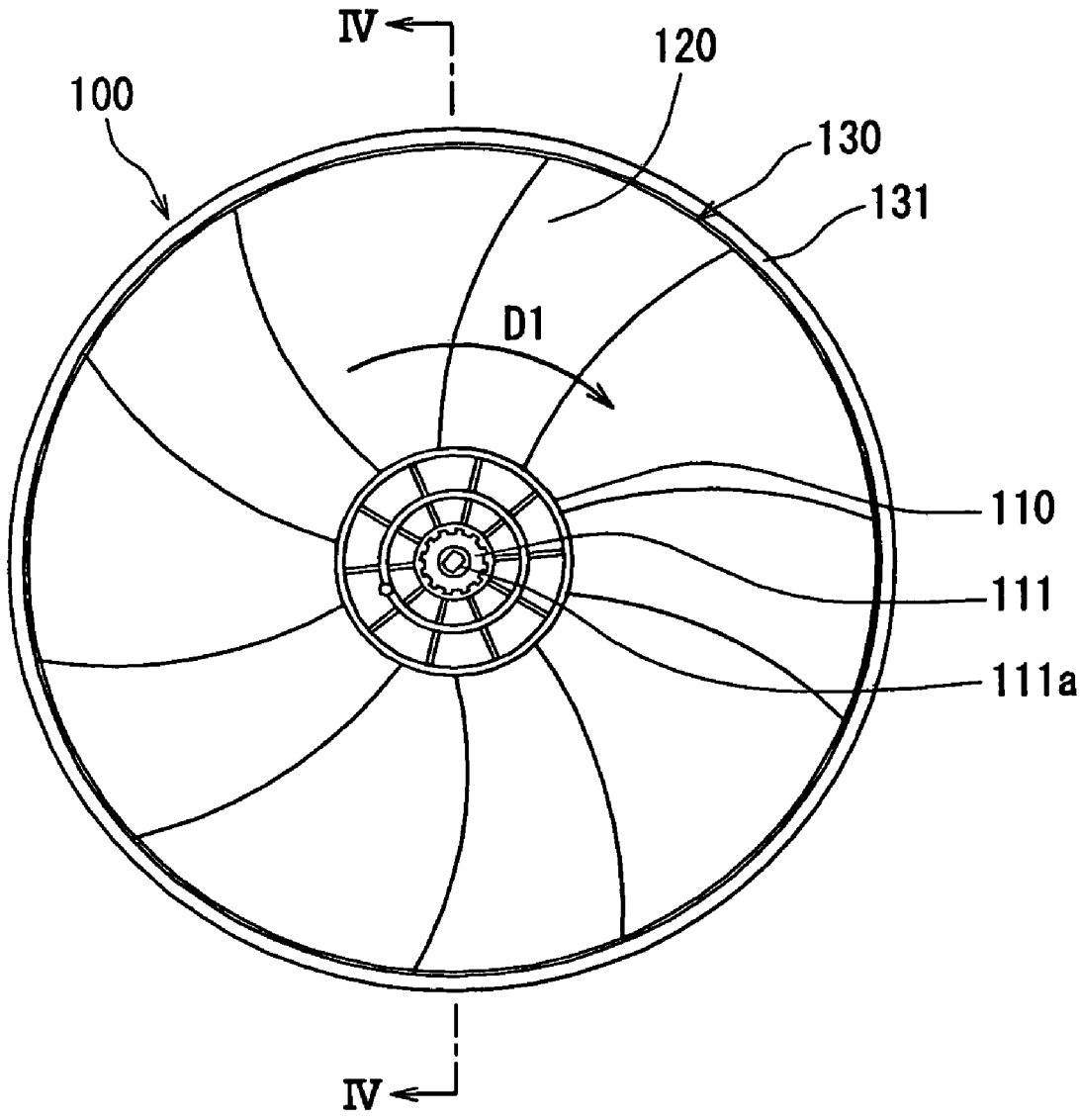
FIG. 3 is a plan view of the cooling fan according to the example embodiment of the present invention.
Figure 4:
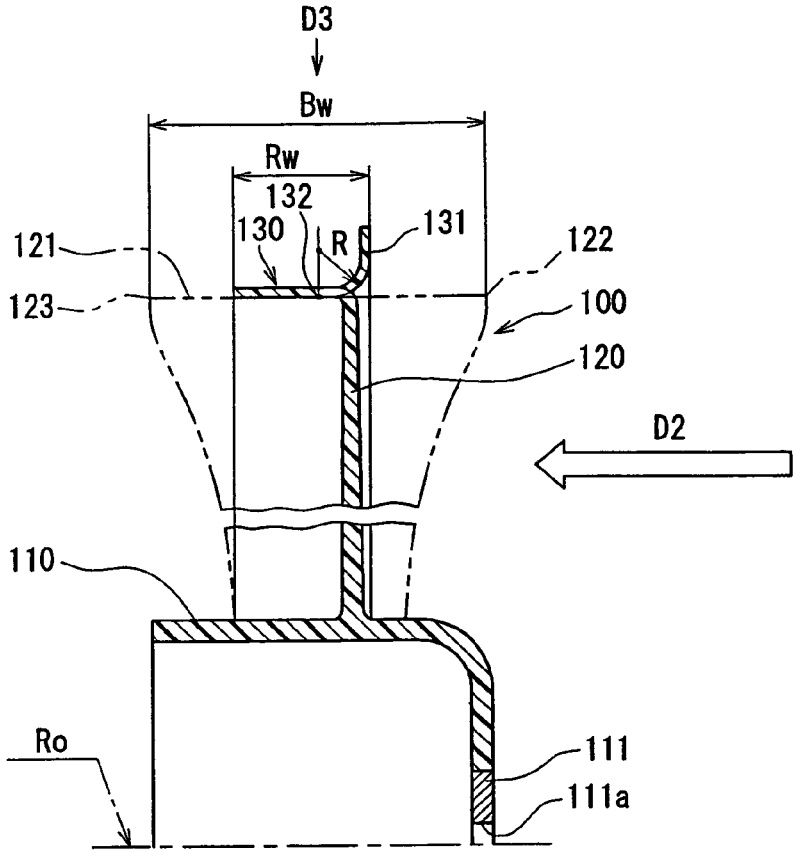
FIG. 4 is a schematic cross-sectional view of the cooling fan taken along a line IV-IV in FIG. 3.

The cooling fan 100 is an axial flow fan. The cooling fan 100 is made of polypropylene including generally 20% of glass fiber. As shown in FIGS. 3 and 4, the cooling fan 100 has a boss portion 110, blades 120, and a ring portion 130. The boss portion 110, the blades 120, and the ring portion 130 are integrally formed by injection molding. In FIG. 3, the cooling fan 100 rotates clockwise. In FIGS. 3 through 6, an arrow D1 denotes a rotation direction of the cooling fan 100, and an arrow D2 denotes a general flow direction of air.

As shown in FIG. 4, the boss portion 110 has a cylindrical shape. An axis of the cylindrical boss portion 110 coincides with a rotation axis $R_0$ of the cooling fan 100. An upstream end of the boss potion 110, which is on an upstream side (right side in FIG. 4) with respect to the air flow direction D2, is closed with a wall. A downstream end of the boss portion 11, which is on a downstream side (left side in FIG. 4) with respect to the air flow direction D2, is open.

A metal insert 111 is inserted in a middle of the wall, which closes the axial end of the cylindrical boss portion 110, by insert molding. The metal insert 111 is for example made of aluminum. Further, at the center of the metal insert 111, a shaft hole 111*a* is formed to receive and engage with a shaft of the motor 300.

The blades (e.g., five blades) 120 are arranged to extend from an outer periphery of the boss portion 110 in a radial direction. An outside diameter of the cooling fan 100 is 340 mm, for example. In general, the outside diameter of the cooling fan 100 is set within a range generally between 250 mm and 400 mm, in consideration of mountability to the vehicle and air blowing efficiency.

The ring portion 130 has a substantially ring or annular shape and is located at the radial outside edges 121 of the blades 120. The ring portion 130 has a ring width (axial dimension) Rw smaller than a blade width (axial dimension) Bw of the blade 120 at the radial outside edge 121, with respect to an axial direction D4 of the boss portion 110. For example, a ratio of the ring width Rw to the blade width Bw is in a range between 20% and 80%. In FIG. 4, a chain double-dashed line shows a path of the blades 120 during rotation.

Further, the ring portion 130 has an annular wall and an extending portion 131. The annular wall extends in a direction generally parallel to the rotation axis $R_0$. The extending portion 131 extends from an upstream end of the annular wall of the ring portion 130 in a form of bell toward an upstream position of the blade 120 with respect to the air flow. Also, the extending portion 131 expands in a radial outward direction while curving (portion denoted by R).

Further, a ring base point (starting point of the curve R) 132 of the extending portion 131 is arranged in a range encompassing 60% of the blade width Bw, the range beginning at 25% of a distance from an upstream end 122 of the radial outside edge 121 of the blade 120, with respect to the axial direction D4 of the boss portion 110. That is, the ring base point 132 is arranged in a range that begins at a point 25% and ends at a point 85% of the distance from the upstream end 122, with respect to the blade width Bw.

More preferably, the base point 132 is arranged in a range that begins at a point 35% and ends at a point 75% of the distance from the upstream end 122 of the radial outside edge 121 of the blade 120. In the example embodiment, the base point 132 is arranged at a point substantially 50% of the blade width Bw, as shown in FIG. 4. As such, the upstream end 122 of the radial outside edge 121 of the blade 120 protrudes from the ring portion 130 in the axial direction D4.

Figure 5:
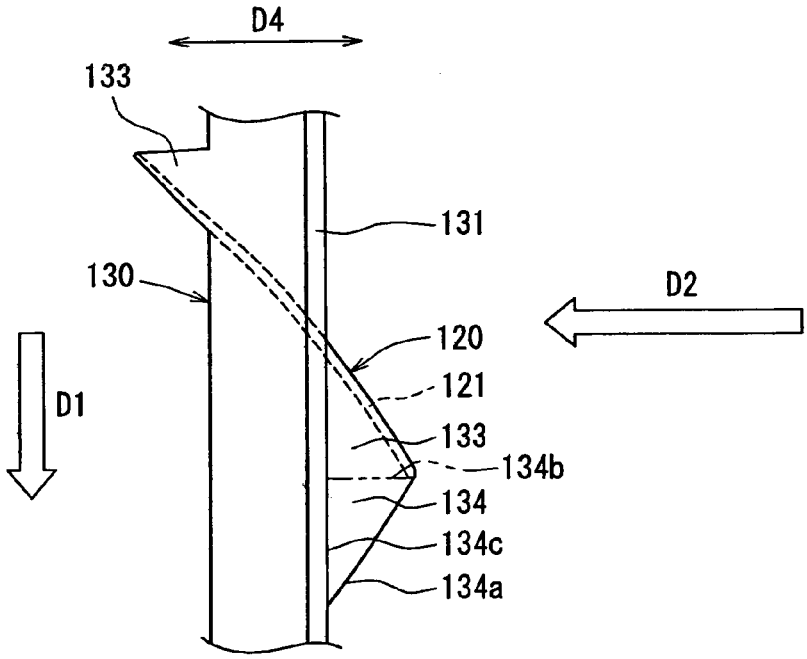
FIG. 5 is a side view of the cooling fan, when viewed from a radial outside, i.e., in a direction denoted by an arrow D3 in FIG. 4, according to the example embodiment of the present invention.
Figure 6:
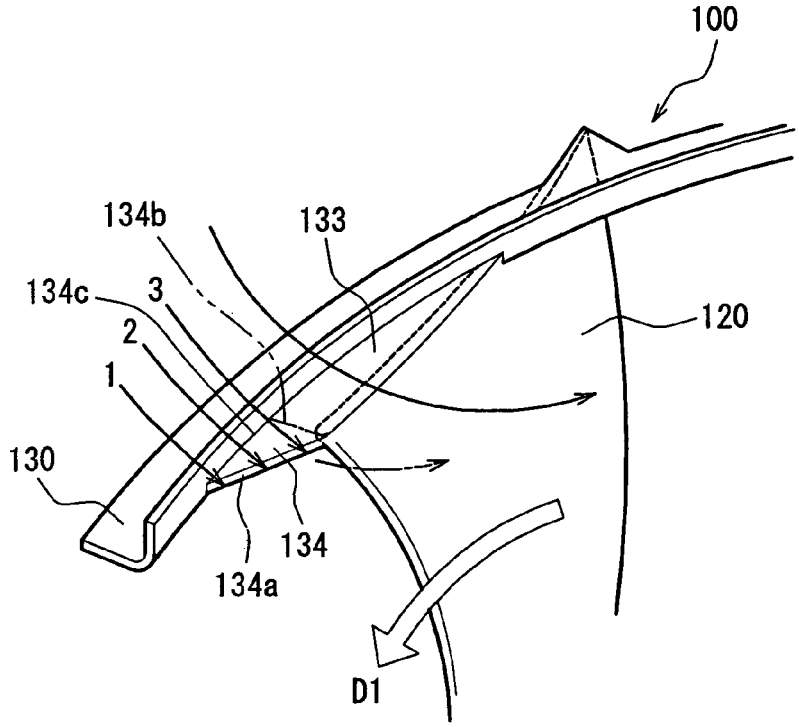
FIG. 6 is an explanatory enlarged perspective view of the cooling fan according to the example embodiment of the present invention.

Furthermore, connecting walls (first connecting walls) 133 each having a substantially triangular shape are provided on the radial outside edge 121 of the blade 120 on an upstream position and a downstream position of the ring portion 130, respectively, as shown in FIG. 5. That is, the connecting walls 133 are provided on an upstream portion and a downstream portion of the radial outside edge 121 of the blade 120, the upstream portion and the downstream portion protruding in the axial direction from an upstream end and a downstream end of the annular wall of the ring portion 130, respectively. The connecting walls 133 extend in the axial direction and connect to the annular wall of the ring portion 130.

In addition, an extending wall (second connecting wall) 134 is provided on a leading side of the connecting wall 133 that is provided on the upstream portion of the radial outside edge 121 of the blade 120, with respect to the rotation direction D1, as shown in FIG. 5. The extending wall 134 continuously extends from a leading end of the connecting wall 133 in the rotation direction D1. The extending wall 134 has a substantially triangular shape.

For example, the extending wall 134 is formed between the connecting wall 133 and the ring portion 130 in the form of right-angled triangle. A first side 134*b* of the extending wall 134 connects to the leading end of the connecting wall 133. A second side 134*c* of the extending wall 134, which is on a side opposite to the first side 134*b* with respect to the right-angled corner, connects to the ring portion 130.

Also, a third side 134*a* of the extending wall 134, which is a hypotenuse of the right-angled triangle and corresponds to a leading end of the extending wall 134, is inclined from the axial direction D4. The third side 134*a* has a first end on a downstream side and a second end on an upstream side. The third side 134*a* is inclined such that the first end leads the second end in the rotation direction D4. For example, the third side 134*a* is inclined with respect to the axial direction D4 in a range between 5° and 60°. Preferably, the third side 134*a* is inclined substantially 20° from the axial direction D4.

The shroud 200 shown in FIG. 1 is made of polypropylene including generally 25% to 30% of glass fiber. The fixing portions 250, which are used to mount to the radiator, and respective portions 210 through 240 of the shroud 200 are integrally formed by injection molding. An external shape, i.e., an outline of the shroud 200 corresponds to the shape of the core portion 1*a* of the radiator. For example, the shroud 200 has a rectangular outline.

In a substantially middle portion of the shroud 200, a shroud ring portion 210 is formed so as to surround the cooling fan 100. In a condition that the cooling fan 100 is fixed to the shroud 200 with the motor 300, the shroud ring portion 210 is located on a radial outside of the ring portion 130, as shown in FIG. 2.

Also, an air guide portion 220 is formed between the shroud ring portion 210 and the rectangular peripheral portion (base portion) of the shroud 200. The air guide portion 220 expands from the shroud ring portion 210 toward an upstream position of the cooling fan 100 with respect to the air flow. As shown in FIG. 2, a base point (starting point) 221 of the air guide portion 220, which connects to the shroud ring portion 210, is located at a position adjacent to the base point 132 of the extending portion 131 of the ring portion 130.

A motor holding portion 230, in a form of circle, is formed at a center of the shroud ring portion 210, as shown in FIG. 1.

The motor holding portion 230 is supported by a plurality of motor stays 240 extending in the radial direction and connecting to the shroud ring portion 210.

The motor 300 is fixed to the motor holding portion 230, and the shaft (not shown) of the motor 300 is received in and engaged with the shaft hole 111*a* of the cooling fan 100. Thus, the shaft of the motor 300 and the cooling fan 100 are fixed to each other. For example, the motor 300 is a well known d.c. ferrite motor and is connected to a controller (not shown). The controller is provided to vary an average current value by changing an ON-OFF time ratio of electric current supplied to the motor 300. Thus, a rotation speed of the cooling fan 100, which is directly connected, is varied in accordance with a required cooling performance of the radiator, thereby controlling the amount of air blown by the cooling fan 100.

In the above blower unit 10, the cooling fan 100 is driven by the motor 300, so the flow of cooling air is caused to pass through the core portion 1*a* of the radiator. As such, radiation of heat of a cooling water flowing through an inside of the radiator is facilitated.

In the above described cooling fan 100, the triangular extending wall 134 is formed on the leading side of the connecting wall 133 with respect to the rotation direction D1. The extending wall 134 has the leading end 134*a* inclined with respect to the rotation axis D4. During the rotation of the cooling fan 100, the leading end 134*a* moves diagonally in the rotation direction D1, i.e., sequentially moves as going across air flowing from the radial outside of the blades 120 as shown by arrows 1, 2, 3 in FIG. 6. Accordingly, it is less likely that air flow will be disturbed at the leading end 134*a* of the upstream portion 122 of the blade 120. Further, noise due to disturbance of air will be reduced.

Figure 7:
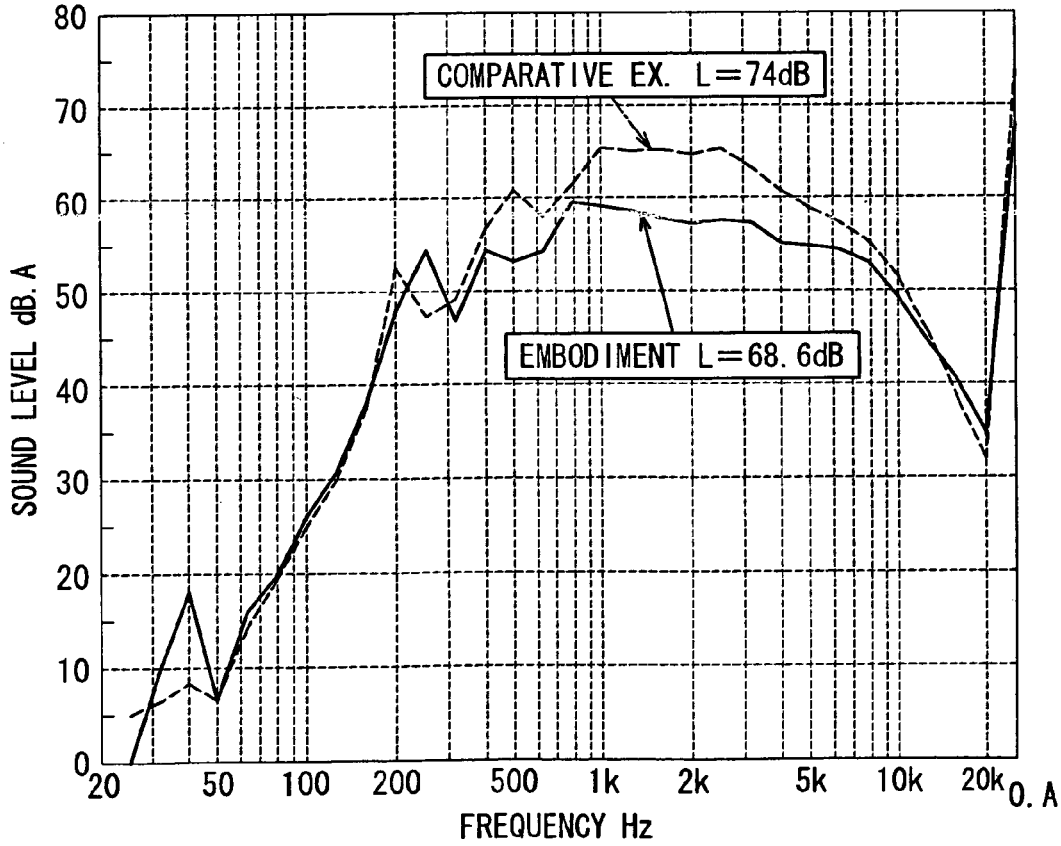
FIG. 7 is a graph for showing measured results of a sound level of the cooling fan of the example embodiment and a sound level of a comparative fan without having an extending wall with respect to frequency.

FIG. 7 shows measured results of a sound level with respect to ⅓ octave-band frequency. In the cooling fan 100 of the example embodiment having the extending wall 134, the sound level is reduced over a wide frequency area, and an overall level L is 68.6 dB. On the contrary, in a comparative fan without having the extending wall 123 as a comparative example, an overall level L is 74 dB. Accordingly, the sound level of the cooling fan 100 of the example embodiment is reduced by 5.4 dB, as compared with the comparative fan, at the overall level L. Also, the cooling efficiency of the embodiment fan is substantially similar to that of the comparative fan without having the extending wall 134. Therefore, there is no adverse influence to the cooling efficiency, which had been obtained in the comparative fan.

(Modifications)

In the above embodiment, the extending wall 134 has the right-angled triangular shape. However, the shape of the extending wall 134 is not limited to the right-angled shape as long as the leading end 134*a* is inclined with respect to the rotation axis D4. Also, it is not always necessary that the leading end 134*a* is straight. The leading end 134*a* can be outwardly or inwardly curved as long as the leading side 134*a* is inclined with respect to the axial direction D4 and sequentially goes across with respect to the air flowing in the fan 100 in the radially inward direction.

Figure 8:
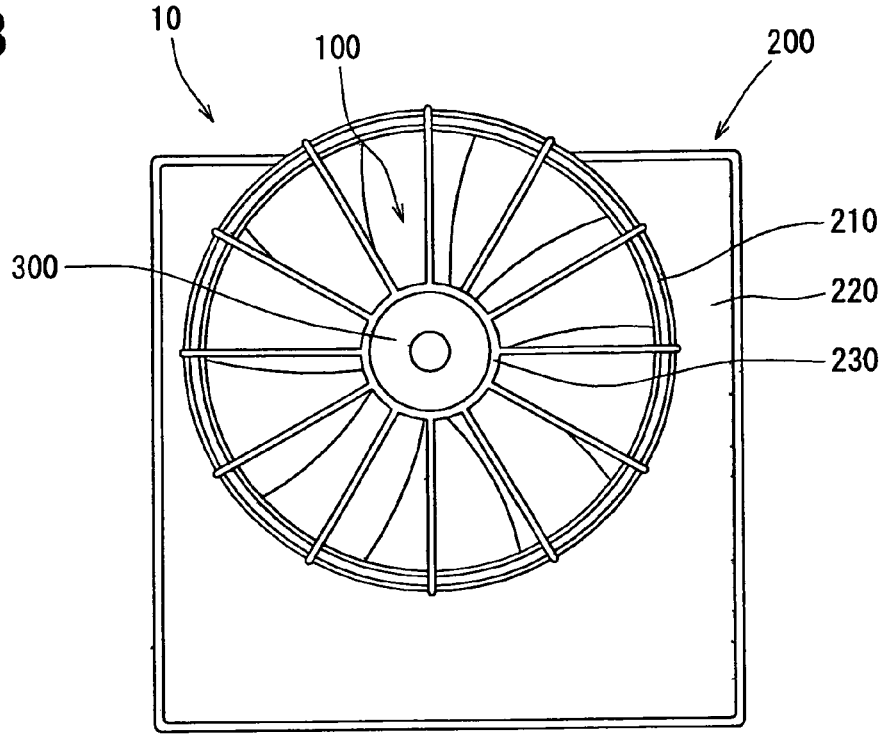
FIG. 8 is a plan view of a blower unit having the cooling fan according to another example embodiment of the present invention.
Figure 9:
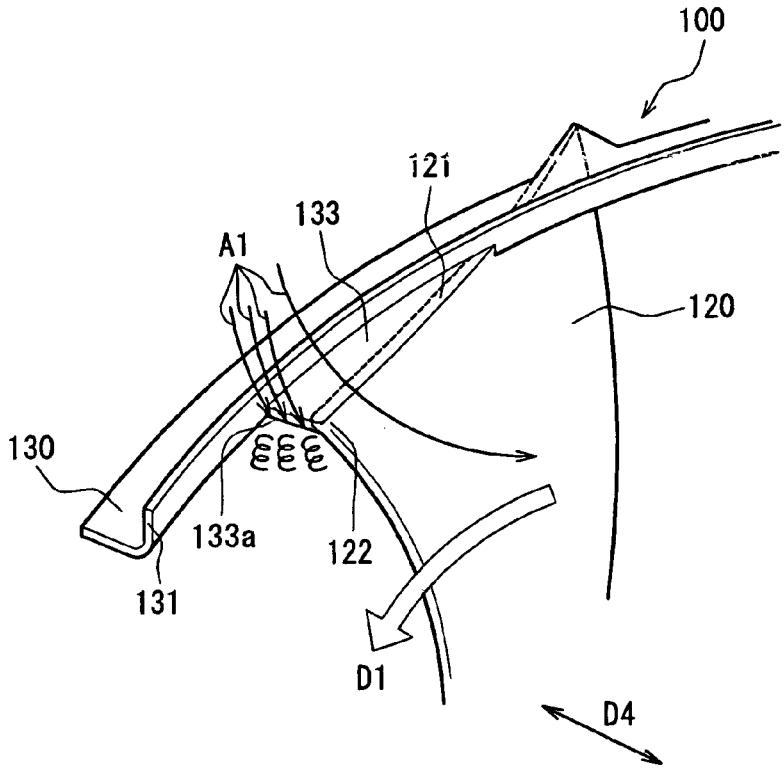
FIG. 9 PRIOR ART
FIG. 9 is an explanatory perspective view of a cooling fan as a prior art.

In the above embodiment, the cooling fan 100 is arranged in the shroud 200 such that the radial outside ends 121 of the cooling fan 100 are included within the rectangular outline of the shroud 200, when viewed in the axial direction D4 as show in FIG. 1. However, the cooling fan 100 can be employed to the blower unit in which the rotation axis $R_0$ of the fan is displaced from a center of the shroud 200 and the radial outside ends 121 of the fan 100 are partly located outside of the rectangular outline of the shroud 200, as shown in FIG. 8. In this case, air flow is likely to be disturbed at the position located outside of the outline of the shroud 200. By employing the cooling fan 100 of the embodiment to the blower unit shown in FIG. 8, a noise reduction effect can be effectively enhanced.

Further, the blower unit 10 is not limited to the suction-type, but may be employed to a squeeze-type in which the air guide portion 220 of the shroud 200 and the core portion 1*a* are located downstream of the cooling fan 100 with respect to the air flow direction.

In the above embodiment, the cooling fan 100 is employed in the blower unit 10 that is driven by the electric motor 300. However, the present invention is not limited to the above. For example, the cooling fan 100 can be used for an engine fan that is rotated by a driving force of a vehicle engine.

In the above embodiment, the cooling fan 100 is provided to cause air flow to pass through the radiator 100. However, the use of the cooling fan 100 is not limited to the above. The cooling fan 100 can be used for heat exchangers for another purposes, such as for a condenser for condensing a refrigerant in an air conditioner, an oil cooler for cooling oil, an intercooler for cooling an intake air.

Further, in relation to the improvement of the air blowing efficiency, the connecting wall 133 can be provided on only the upstream side of the radial outside end 121 of the blade 120. Alternatively, the connecting wall 133 can be provided at a part of the radial outside edge 121 of the blade 120 at which the ring portion 130 is not formed.

The example embodiments of the present invention are described above. However, The present invention is not limited to the above embodiments, but may be implemented in other ways without departing from the spirit of the invention.

What is claimed is:

1. A fan comprising:

a plurality of blades extending in a radial direction with respect to a rotation axis;

a ring portion disposed on radial outside edges of the blades, wherein a portion of the radial outside edge of each of the blades protrudes from the ring portion toward an upstream position with respect to a flow direction of air, the ring portion including an annular wall extending generally parallel to the rotation axis and an extending portion extending from an upstream end of the annular wall in a radial outward direction;

a first connecting wall extending between the ring portion and the portion of the radial outside edge of the blade; and a second connecting wall having a generally triangular shape, wherein the second connecting wall extends from the first connecting wall and connects to the ring portion on a leading side of the first connecting wall with respect to a rotation direction of the blade.

2. The fan according to claim 1, wherein the second connecting wall defines a leading end portion on a leading side thereof with respect to the rotation direction, and the leading end portion is inclined with respect to the rotation axis.

3. The fan according to claim 2, wherein an inclination angle of the leading end portion with respect to the rotation axis is in a range between 5° and 60°.

4. The fan according to claim 2, wherein an inclination angle of the leading end portion with respect to the rotation axis is generally 20°.

5. The fan according to claim 2, wherein the leading end portion has a first end connecting to the ring portion and a second end connecting to the first connecting wall, and the leading end portion is inclined such that the first end leads the second end with respect to the rotation direction.

6. The fan according to claim 1, wherein the second connecting wall extends from the first connecting wall and connects to the upstream end of the annular wall.

7. A blower unit having a fan according to claim 1, comprising:

a shroud housing the fan therein, wherein the shroud has a base portion defining a substantially rectangular outline, a shroud ring portion, and an air guide portion extending between the base portion and the shroud ring portion, and the fan is disposed such that the extending portion of the fan is disposed along an inner surface of the air guide portion and the annular wall of the fan is located radially inside of the shroud ring portion.

8. A blower unit comprising:

a fan comprising:

a plurality of blades extending in a radial direction with respect to a rotation axis;

a ring portion disposed on radial outside edges of the blades, wherein a portion of the radial outside edge of each of the blades protrudes from the ring portion toward an upstream position with respect to a flow direction of air;

a first connecting wall extending between the ring portion and the portion of the radial outside edge of the blade;

a second connecting wall having a generally triangular shape, wherein the second connecting wall extends from the first connecting wall and connects to the ring portion on a leading side of the first connecting wall with respect to a rotation direction of the blade;

a shroud housing the fan therein, wherein the shroud has a base portion defining a substantially rectangular outline, a shroud ring portion defining an annular wall and an air guide portion extending between the base portion and the shroud ring portion, and the fan is disposed such that the ring portion of the fan is located radially inside of the shroud ring portion.

9. The blower unit according to claim 8, wherein the fan is disposed such that the rotation axis is displaced from a central portion of the shroud and the fan is partly located outside of the outline of the base portion of the shroud.

10. The blower unit according to claim 8, wherein the shroud ring portion is partly located outside of the outline of the base portion when viewed in a direction parallel to the rotation axis of the fan.

11. A fan comprising:

a plurality of blades extending in a radial direction with respect to a rotation axis;

a ring portion disposed on radial outside edges of the blades, wherein a portion of the radial outside edge of each of the blades protrudes from the ring portion with respect to a flow direction of air, the ring portion including an annular wall extending generally parallel to the rotation axis and an extending portion extending from an upstream end of the annular wall in a radial outward direction; and a connecting wall extending between the ring portion and the portion of the radial outside edge of the blade, wherein the connecting wall defines a leading end portion on a leading side thereof with respect to a rotation direction, and the leading end portion has a first end adjacent to the ring portion and a second end adjacent to the portion of the radial outside edge of the blade, and the leading end portion is inclined such that the first end leads the second end in the rotation direction.

12. A fan for a blower having a shroud, the fan comprising:

a plurality of blades extending in a radial direction with respect to a rotation axis;

a fan ring portion disposed on radial outside edges of the blades, wherein a portion of the radial outside edge of each of the blades protrudes from the ring portion toward an upstream position with respect to a flow direction of air;

a connecting wall extending between the fan ring portion and the portion of the radial outside edge of the blade; and a noise reducing wall extending from the connecting wall and connecting to the fan ring portion on a leading side of the connecting wall with respect to a rotation direction of the blade, the noise reducing wall having a leading end inclined with respect to the rotation axis.

13. The fan according to claim 12, wherein the fan ring portion includes an annular wall and an extending wall, the annular wall extends generally parallel to the rotation axis to be disposed on a radial inside of a shroud ring portion of the shroud, and the extending wall extends from an upstream end of the annular wall in a radial outward direction in a form of bell to be disposed along an inner surface of an air guide portion of the shroud.

* * * * *

UNITED STATES PATENT AND TRADEMARK OFFICE

CERTIFICATE OF CORRECTION

PATENT NO. : 7,632,063 B2
APPLICATION NO. : 11/526808
DATED : December 15, 2009
INVENTOR(S) : Takeuchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 525 days.

Signed and Sealed this

Second Day of November, 2010

David J. Kappos

David J. Kappos
*Director of the United States Patent and Trademark Office*